US006015156A

United States Patent [19]

Pratt

[11] Patent Number: 6,015,156

[45] Date of Patent: Jan. 18, 2000

[54] SKATE WITH DETACHABLE BOOT

[75] Inventor: Michael K. Pratt, Worcester, Mass.

[73] Assignee: Seneca Sports, Inc., Milford, Mass.

[21] Appl. No.: 09/096,235

[22] Filed: Jun. 11, 1998

[51] Int. Cl.[7] ..... A63C 17/02

[52] U.S. Cl. ..... 280/11.22; 280/11.3

[58] Field of Search ..... 280/7.13, 7.14, 280/8, 9, 10, 11.22, 11.23, 11.3, 11.31, 11.32, 11.33

[56] References Cited

U.S. PATENT DOCUMENTS

| | | | |
|---|---|---|---|
| 19,706 | 9/1935 | Johnson | 208/168 |
| 44,066 | 9/1861 | Bergner . | |
| 2,244,719 | 6/1941 | Mansfield | 280/11.3 |
| 2,470,840 | 5/1949 | Anz | 280/11.3 |
| 2,998,260 | 8/1961 | Meyer | 280/7.13 |
| 4,150,499 | 4/1979 | Wang | 36/115 |
| 4,298,209 | 11/1981 | Peters | 280/11.2 |
| 4,351,536 | 9/1982 | Sandino | 280/7.13 |
| 4,570,955 | 2/1986 | Winkler et al. | 280/11.2 |
| 4,657,265 | 4/1987 | Ruth | 280/7.13 |
| 4,666,168 | 5/1987 | Hamill et al. | 280/11.2 |
| 4,928,982 | 5/1990 | Logan | 280/11.22 |
| 4,932,675 | 6/1990 | Olson et al. | 280/7.13 |
| 4,988,122 | 1/1991 | Saunders | 280/841 |
| 5,127,672 | 7/1992 | Horibata | 280/842 |
| 5,193,827 | 3/1993 | Olson | 280/7.13 |
| 5,232,231 | 8/1993 | Carlsmith | 280/11.2 |
| 5,314,199 | 5/1994 | Olson et al. | 280/7.13 |
| 5,331,752 | 7/1994 | Johnson et al. | 36/115 |
| 5,393,077 | 2/1995 | Wanous | 280/7.13 |
| 5,398,970 | 3/1995 | Tucky | 280/841 |
| 5,507,506 | 4/1996 | Shadroui | 280/11.22 |
| 5,524,912 | 6/1996 | Laub et al. | 280/7.13 |
| 5,549,310 | 8/1996 | Meibock et al. | 280/11.22 |
| 5,615,901 | 4/1997 | Piotrowski | 280/7.14 |

*Primary Examiner*—Richard M. Camby
*Attorney, Agent, or Firm*—Fish & Richardson P.C.

[57] ABSTRACT

An in-line skate has a wheeled chassis and a detachable boot for walking. The chassis has an elongated frame and a multiplicity of wheels mounted to the frame. The frame has a projection extending from it, the projection having a stem and an overhanging head at the distal end of the stem. The frame also includes an elongated rib, with a cantilevered extension, extending from the frame in spaced relation to the projection, along the length of the frame. The boot is adapted for releasable attachment to the chassis, and has an upper attached to a flexible sole with a tread for walking upon. The sole defines a slot adapted to receive the rib of the frame. The slot has an undercut at one end for retaining the cantilevered extension of the rib to resist separation of the attached boot and chassis. The sole also contains a movable clip positioned to receive and releasably engage the projection to resist separation of the attached boot and chassis. In another embodiment, the location of the projection and the clip are reversed. Methods of employing this structure to remove the wheeled chassis from the boot are also described.

14 Claims, 4 Drawing Sheets

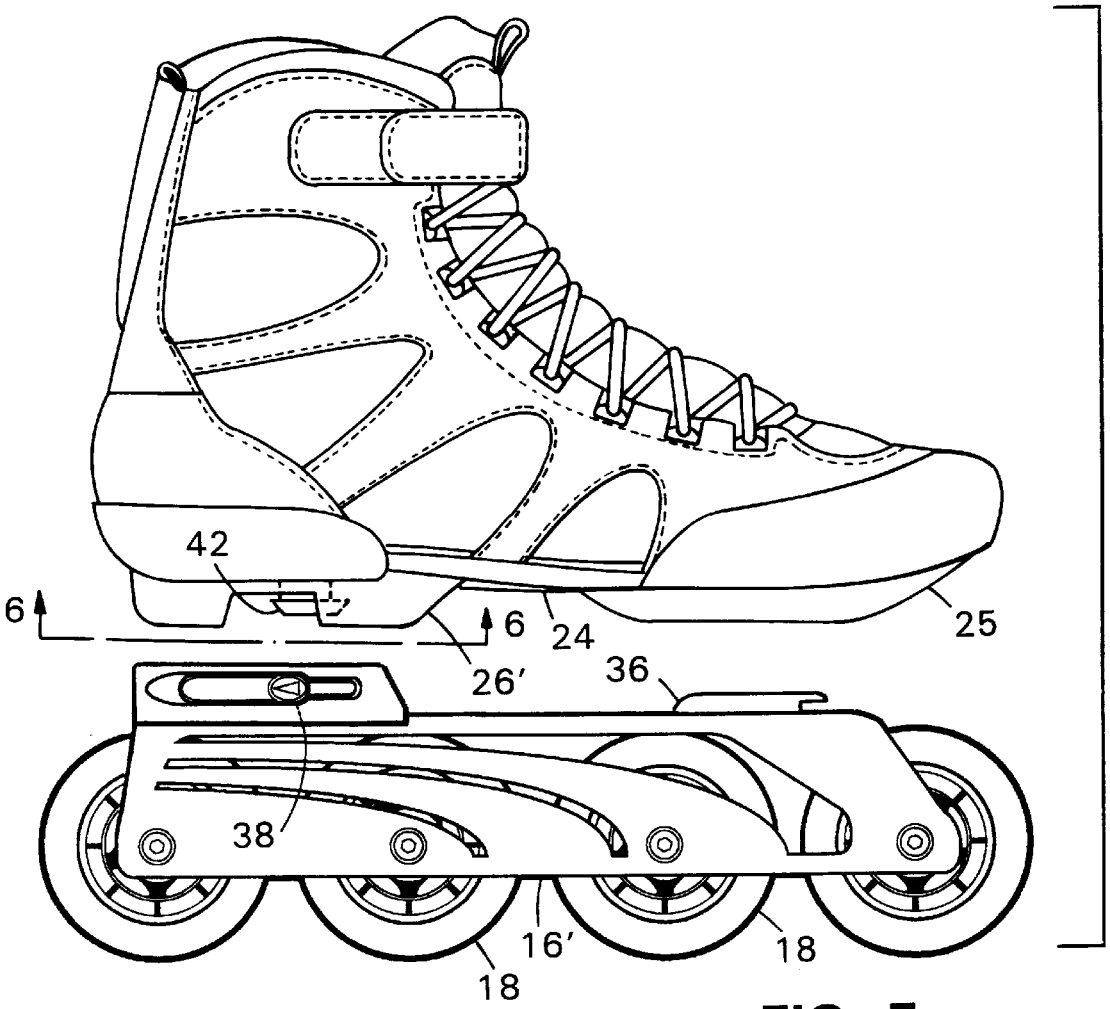
FIG. 5
FIG. 6
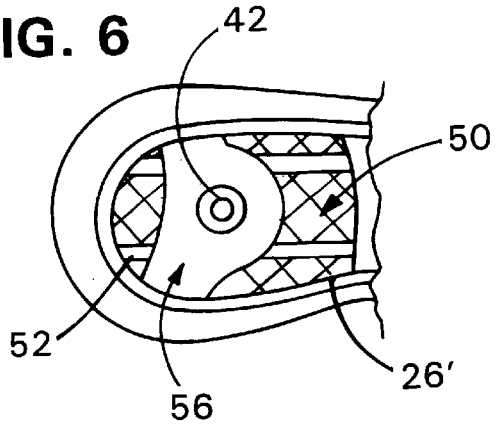

SKATE WITH DETACHABLE BOOT

BACKGROUND OF THE INVENTION

This invention relates to in-line wheeled skates, particularly to in-line wheeled skates having removable boots for walking.

In-line wheeled skates are a popular mode of transportation, especially in urban areas. Most in-line skates in use today are intended for skating only, and must be removed for walking and other activities. Many users, therefore, carry their skates while walking and their shoes while skating.

Some attempts have been made to produce a convertible skate, in which the boot is removable from the wheeled chassis for walking. Many in-line skate boots, however, are made of heavy, rigid plastic (similar in that respect to ski boots), and do not provide the flexibility and comfort for sustained walking. In addition, a boot attachment mechanism is needed which does not require tools, is intended for repeated use and quick conversions, and provides sufficient stiffness for today's aggressive skating maneuvers.

SUMMARY OF THE INVENTION

This invention features a skate with a flexible-soled boot which is easily and quickly dismountable for comfortable sustained walking. While walking, the user need only carry or stow the wheeled chassis of the skates, which are less bulky and cumbersome than full skates. The sole of the boot has a tread adapted for walking upon, yet the attachment to the wheeled skate is sufficiently rigid for active skating.

According to one aspect of the invention, an in-line skate has a wheeled chassis and a boot, the wheeled chassis including an elongated frame and a multiplicity of wheels mounted to the frame. The frame has both a projection and an elongated rib extending from the frame. The projection has a stem and an overhanging head at the distal end of the stem, and the elongated rib, extending in spaced relation to the projection, has a cantilevered extension. The boot is adapted for releasable attachment to the chassis, and has an upper attached to a flexible sole having a tread for walking upon. The sole defines within it a slot adapted to receive the rib of the frame, the slot defining an undercut at one end of the slot for retaining the cantilevered extension of the rib to resist separation of the attached boot and chassis. The sole also has a movable clip positioned to receive and releasably engage the projection to resist separation of the attached boot and chassis.

Preferably, the boot is compliant.

In some embodiments, the sole has a molded sole plate of flexible thermoplastic resin, and forefoot and heel pieces of elastomeric material connected to and extending downward from the molded sole plate and defining bottom surfaces with tread for walking upon.

In some cases the skate has a metal toe plate embedded within the sole of the boot and defining the slot for receiving the rib of the chassis.

In one illustrated embodiment, the clip has two lever arms pivotably attached to the boot at a common point, the arms arranged to pivot about the point from a projection-retaining position to a projection-releasing position. The clip also has a spring arranged to bias the arms toward their projection-retaining position.

Preferably the slots are defined in a forefoot region of the sole, and the clip is disposed in a heel region of the sole.

In some cases the frame has two ribs extending in parallel relation from the frame, the sole defining two parallel slots for receiving the two ribs.

The frame may be made of any of several available structural materials, including aluminum.

According to another aspect, an in-line skate has the structure recited in the first aspect, except that the frame has the movable clip and the boot includes the projection, disposed within a recess. This aspect has, in various embodiments, other features described above with respect to embodiments of the first aspect.

According to another aspect, the invention provides a method of removing a wheeled chassis from the boot of an in-line skate for wearing the boot for walking. The method includes providing an in-line skate as described above, moving the clip to release the projection, partially separating the boot from the frame, sliding the boot relative to the frame to disengage the cantilevered extension from the slot, and removing the frame from the boot.

The convertible skate featured in the invention can provide enhanced freedom for skaters, allowing them to easily remove the chassis and enter stores, subways and other areas inaccessible with traditional in-line skates, while providing comfortable footwear for sustained walking.

Other features and advantages will be apparent from the following description and claims.

BRIEF DESCRIPTION OF THE DRAWING

FIG. 5 illustrates a second embodiment, having the dismounting clip on the skate frame instead of on the boot.

FIG. 6 is a cross-sectional view, taken along line 6—6 in FIG. 5.

DESCRIPTION OF EMBODIMENTS

Figure 1:
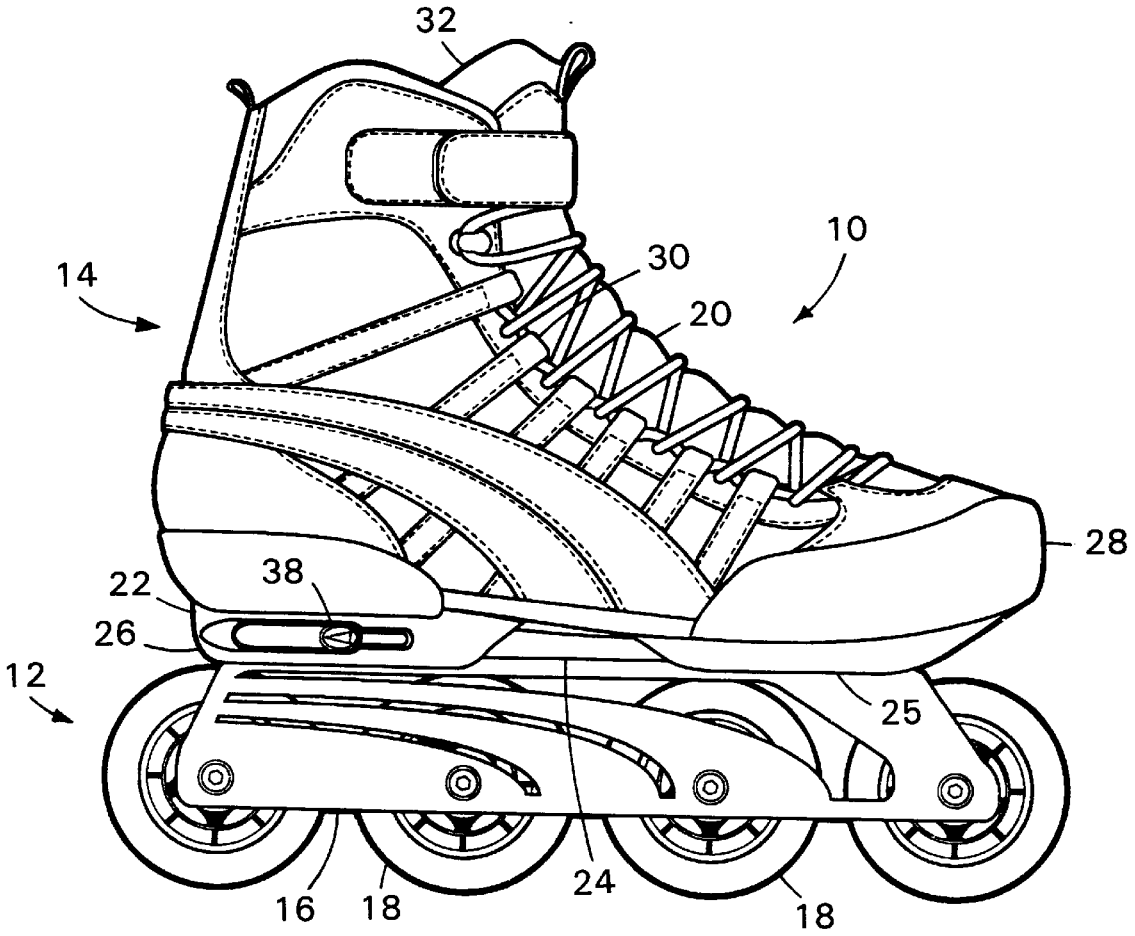
FIG. 1 is a side view of an in-line skate.
Figure 3A:
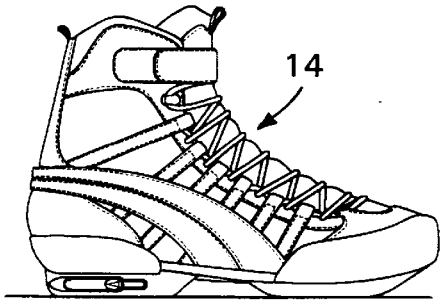
FIGS. 3A and 3B illustrate the flexible, dismounted boot used for walking.
Figure 3B:
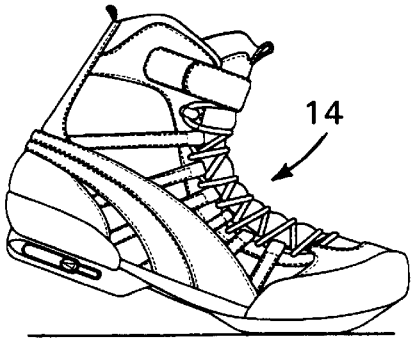

Referring to FIG. 1, in-line skate 10 has a wheeled chassis 12 and a dismountable boot 14. The chassis has an elongated frame 16 (e.g., of extruded aluminum), and a single row of four wheels 18 rotatably mounted to the frame. The boot has a soft, compliant upper 20 and a flexible sole 22. Sole 22 includes a molded thermoplastic sole plate 24 and elastomeric forefoot and heel pieces 25 and 26 which extend downward under the ball and heel of the foot, respectively. Pieces 25 and 26 are molded with tread for walking when the boot is dismounted, and support the chassis attachment hardware described below. As illustrated in FIGS. 3A and 3B, the flexibility of the sole plate enables the sole of the boot to flex during walking as in a walking shoe. The boot upper resembles casual footwear, with outer materials which may include fabric, leather, breathable nylon, or other materials commonly used in uppers of walking and running shoes.

To provide the support needed while skating, upper 20 contains molded plastic structural components (not shown) sandwiched between layers of compliant material. A molded toe cap 28 provides additional toe protection. The boot lacing features nylon lace loops 30 instead of eyelets, and the collar 32 of the boot is padded to provide ankle comfort.

The interior of the boot (not shown) is lined with moisture-wicking material and padded with high density foam.

Figure 2:
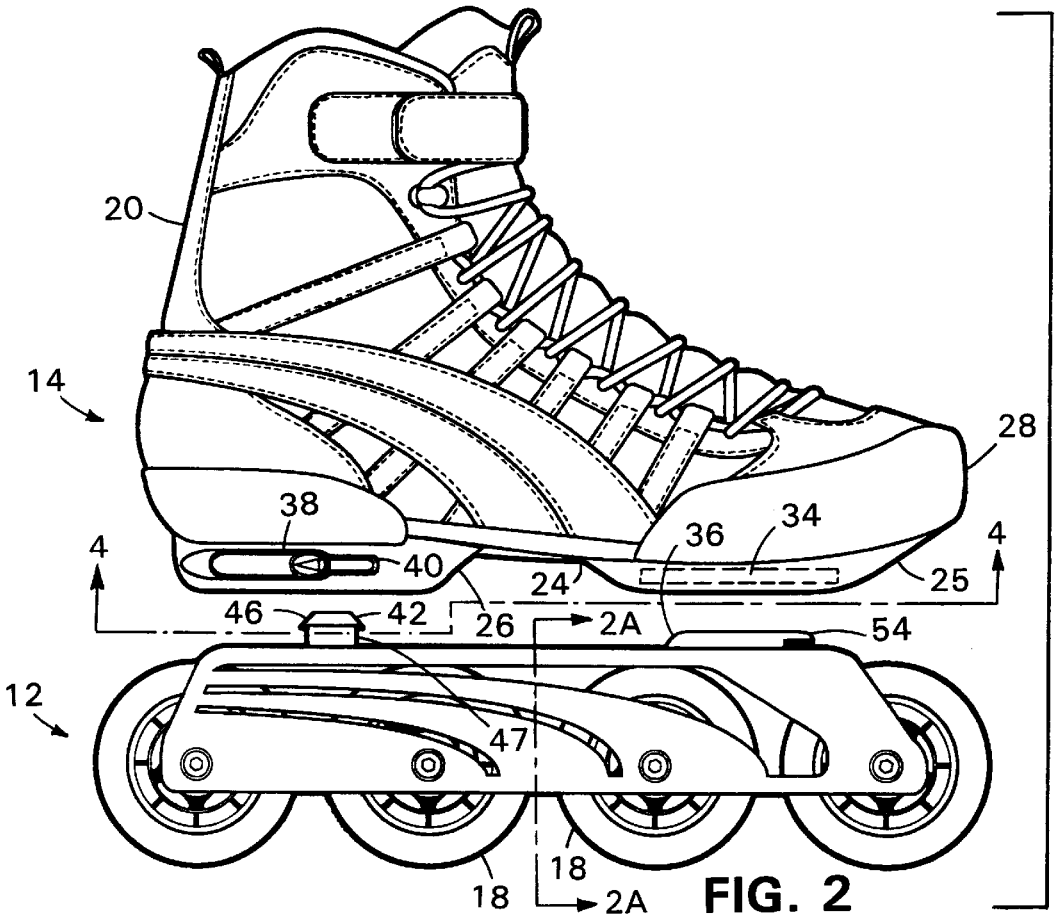
FIG. 2 shows the skate boot dismounted from the skate chassis.
Figure 2A:
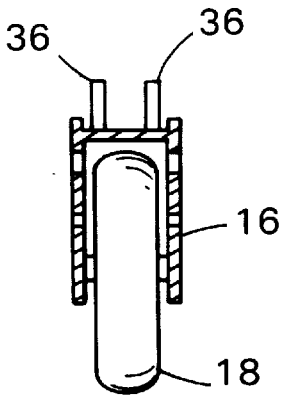
FIG. 2A is a cross-sectional view, taken along line 2A—2A in FIG. 2.

FIG. 2 shows boot 14 dismounted from chassis 12. Shown in dashed outline is a metal toe plate 34 molded into forefoot piece 25 and defining openings (48, FIGS. 4A and 4B) to receive and retain two parallel metal ribs 36 (also shown in FIG. 2A) extending upward from frame 16. Heel piece 26 contains a manually operable clip 38 with two levers that extend through the sides of the heel piece for simultaneous operation with thumb and forefinger.

Figure 4A:
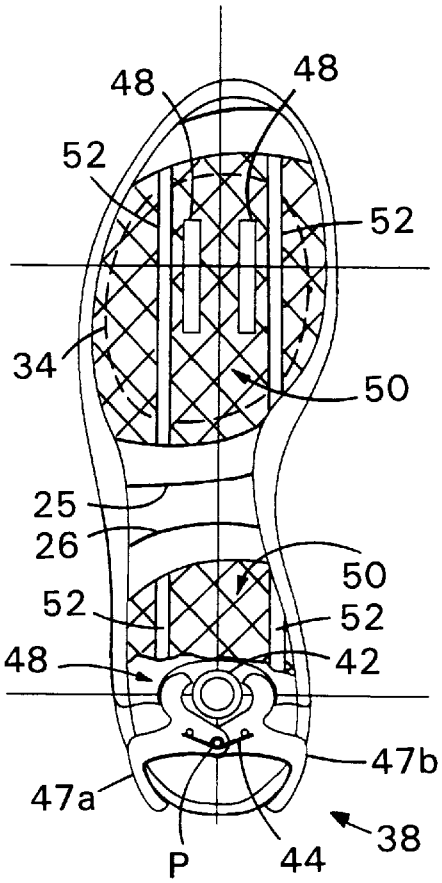
FIGS. 4A and 4B are cross-sectional views of FIG. 2 taken along line 4—4, with a portion of the heel cut away to show the dismounting clip open and closed, respectively.
Figure 4B:
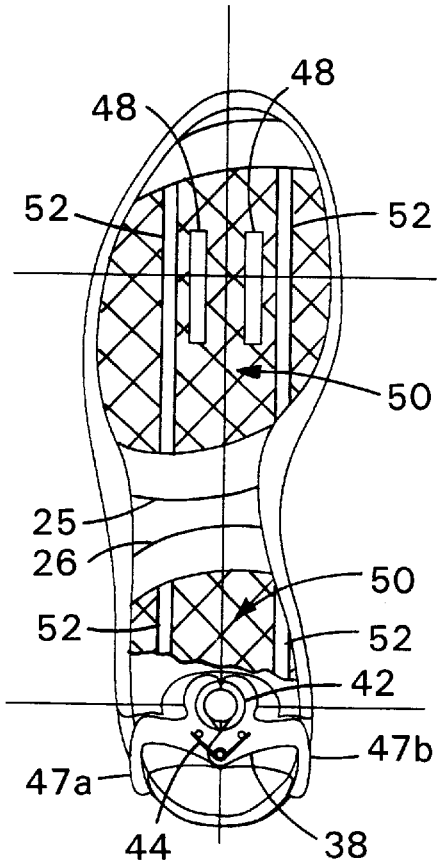

Referring also to FIG. 4A, moving the levers of clip 38 rearward within heel piece slots 40 opens the clip to release a heel pin 42 extending upward from frame 16 between the third and fourth wheels. A wire spring 44 biases the clip levers to a forward position, as shown in FIG. 4B, to hold the clip normally closed about the heel pin, which extends up into an aperture 45 in heel piece 26. Levers 47*a* and 47*b* are pivotably mounted to the sole plate at a common point P. The portion of heel piece 26 which is cut away in FIGS. 4A and 4B normally covers and protects clip 38, defining a single aperture for insertion of the heel pin into the heel piece for engagement by the clip.

FIG. 4A also shows the two slots 48 in forefoot piece 25 and metal toe plate 34 for engaging the chassis frame ribs, as well as the walking tread 50 on the bottom surfaces of both the forefoot and heel pieces 25 and 26.

Tread 50 is illustrated by cross-hatching. Molded longitudinal slots 52 in the forefoot and heel pieces are arranged to accept the upper surfaces of the twin parallel rails of the chassis frame. As shown in FIG. 2, frame ribs 36 have cantilevered extensions 54 at their forward ends for extending into undercuts above the toe plate 34 to engage the metal toe plate at the forward edges of plate slots 48 (FIG. 4A).

To mount the chassis to the boot, frame ribs 36 are first inserted into slots 48 with the boot sole slightly flexed to avoid interference with heel pin 42. The chassis is then slid forward until cantilever extensions 54 are forward of the front edge of slots 48, and pin 42 is pressed into clip 38 until it snaps into place. A chamfer at the top of pin 42 allows the clip to be cammed open automatically to accept the pin by applying downward force with the heel of the boot, or the clip may be manually opened to accept the pin. The clip closes under the overhanging head 46 of pin 42 and about the stem 47 of the pin to secure the heel of the boot to the chassis. To dismount the chassis, clip 38 is manually opened and pin 42 pulled from the opening in the heel of the boot. The chassis is then slid rearward until rib extensions 54 are clear of the toe plate.

In the embodiment illustrated in FIG. 5 the heel attachment has been reversed, with clip 38 on frame 16' and heel pin 42 extending downward within a recess in heel piece 26' of the boot. Clip 38, of similar construction as that shown in FIG. 4A, defines an aperture for receiving the heel pin. The forward mounting arrangement (of ribs and slots) is the same as is shown in FIG. 2. As shown in FIG. 6, pin 42 is disposed within a recess 56 in heel piece 26', providing clearance for the pivoting of the clip levers.

What is claimed is:

1. An in-line skate comprising a wheeled chassis having an elongated frame and a multiplicity of wheels mounted to the frame, the frame having a projection extending therefrom, the projection having a stem and an overhanging head at the distal end of the stem, and an elongated rib extending therefrom, in spaced relation to the projection along the length of the frame, the rib having a cantilevered extension; and a boot adapted for releasable attachment to the chassis, the boot comprising an upper attached to a flexible sole having a tread for walking upon, the sole defining therein a slot adapted to receive the rib of the frame, the slot defining an undercut at one end thereof for retaining the cantilevered extension of the rib to resist separation of the attached boot and chassis, the sole further comprising a movable clip positioned to receive and releasably engage the projection to resist separation of the attached boot and chassis.

2. The in-line skate of claim 1 wherein the sole comprises a molded sole plate of flexible thermoplastic resin; and forefoot and heel pieces of elastomeric material connected to and extending downward from the molded sole plate and defining bottom surfaces with tread for walking upon.

3. The in-line skate of claim 1 comprising a metal toe plate embedded within the sole of the boot and defining the slot for receiving the rib of the chassis.

4. The in-line skate of claim 1 wherein the clip comprises two lever arms pivotably attached to the boot at a common point, the arms arranged to pivot about the point from a projection-retaining position to a projection-releasing position; and a spring arranged to bias the arms toward their projection-retaining position.

5. The in-line skate of claim 1 wherein the sole defines heel and forefoot regions, the slots being defined in the forefoot region and the clip disposed within the heel region.

6. The in-line skate of claim 1 wherein the frame comprises two said ribs extending in parallel relation therefrom, the sole defining two parallel slots for receiving the two ribs.

7. The in-line skate of claim 1 wherein the frame is aluminum.

8. An in-line skate comprising a wheeled chassis having an elongated frame and a multiplicity of wheels mounted to the frame, the frame having an elongated rib extending therefrom, the rib having a cantilevered extension, the chassis also comprising a movable clip in spaced relation to the rib along the length of the frame; the skate further comprising a boot constructed for releasable attachment to the chassis, the boot comprising an upper attached to a molded sole having a tread for walking upon, the sole defining therein a slot adapted to receive the rib of the frame, the slot defining an undercut at one end thereof for retaining the cantilevered extension of the rib to resist separation of the attached boot and chassis, the sole further comprising a projection disposed within a recess and having a stem and an overhanging head at the distal end of the stem, the projection adapted to be received within, and releasably retained by, the movable clip to resist separation of the attached boot and chassis.

9. The in-line skate of claim 8 wherein the sole comprises a molded sole plate of flexible thermoplastic resin; and forefoot and heel pieces of elastomeric material connected to and extending downward from the molded sole plate and defining bottom surfaces with tread for walking upon.

10. The in-line skate of claim 8 comprising a metal toe plate embedded within the sole of the boot and defining the slot for receiving the rib of the chassis.

11. The in-line skate of claim 8 wherein the clip comprises two lever arms pivotably attached to the boot at a common point, the arms arranged to pivot about the point from a projection-retaining position to a projection-releasing position; and a spring arranged to bias the arms toward their projection-retaining position.

12. The in-line skate of claim 8 wherein the sole defines heel and forefoot regions, the slots being defined in the forefoot region and the projection being disposed in the heel region.

13. The in-line skate of claim 8 wherein the frame is aluminum.

14. A method of removing a wheeled chassis from the boot of an in-line skate for wearing the boot for walking, the method comprising providing an in-line skate with a wheeled chassis having an elongated frame and a multiplicity of wheels mounted to the frame, the frame having a projection extending therefrom, the projection having a stem and an overhanging head at the distal end of the stem, and an elongated rib extending therefrom, in spaced relation to the projection along the length of the frame, the rib having a cantilevered extension; and a boot adapted for releasable attachment to the chassis, the boot comprising an upper attached to a flexible sole having a tread for walking upon, the sole defining therein a slot adapted to receive the rib of the frame, the slot defining an undercut at one end thereof for retaining the cantilevered extension of the rib to resist separation of the attached boot and chassis, the sole further comprising a movable clip positioned to receive and releasably engage the projection to resist separation of the attached boot and chassis;

moving the clip to release the projection;

partially separating the boot from the frame;

sliding the boot relative to the frame to disengage the cantilevered extension from the slot; and removing the frame from the boot.

* * * * *